United States Patent [19]

Dapkus

[11] Patent Number: 4,498,677

[45] Date of Patent: Feb. 12, 1985

[54] EXPLOSIVE TARGET

[76] Inventor: John G. Dapkus, P.O. Box 180, Cromwell, Conn. 06416

[21] Appl. No.: 477,819

[22] Filed: Mar. 22, 1983

[51] Int. Cl.[3] ..... F41J 5/06

[52] U.S. Cl. ..... 273/380; 273/378

[58] Field of Search ..... 273/363, 378, 380

[56] References Cited

U.S. PATENT DOCUMENTS

| | | | |
|---|---|---|---|
| 727,419 | 5/1903 | Nelson | 273/363 |
| 1,091,116 | 3/1914 | Buell | 273/378 |
| 1,145,585 | 7/1915 | Hebard | 273/378 |
| 4,243,228 | 1/1981 | Marcella | 273/378 |

*Primary Examiner*—Anton O. Oechsle

*Attorney, Agent, or Firm*—McCormick, Paulding & Huber

[57] ABSTRACT

An explosive target for firearm marksmanship has a hollow rectangular block-shaped body assembly including an internal bore containing an explosive charge which detonates upon projectile impact. A charge retaining disc forcibly inserted within the bore retains the charge adjacent the rear wall of the body assembly. A target imprinted on the front wall of the body assembly is coaxially aligned with the bore.

15 Claims, 2 Drawing Figures

EXPLOSIVE TARGET

BACKGROUND OF THE INVENTION

This invention relates in general to rifle and pistol targets and deals more particularly with an improved explosive target for use in sports shooting and marksmanship trials. The target of the present invention is particularly adapted to enhance entertainment of the marksman and spectators and renders a visible and/or audible signal when a central hit or "bull's eye" has been scored. The target is further adapted to be readily attached to any suitable backing surface and may, if desired, be attached to the "bull's eye" of a conventional pistol or rifle target.

It is the general aim of the present invention to provide an improved target of the aforedescribed general type wherein the target itself provides a shock-resistive package for the explosive material which it contains for improved safety in handling, packaging, storage and shipment.

SUMMARY OF THE INVENTION

In accordance with the present invention an improved explosive target comprises a hollow body assembly which has a generally rectangular block shape configuration. The body assembly includes a body which has a generally cylindrical bore extending through it and front and rear end walls which are attached to the body and form closures for the front and rear ends of the cylindrical bore. An explosive charge is contained within the bore for detonation upon projectile impact. A charge retaining disc mounted in fixed position within the bore maintains the explosive charge generally adjacent one of the end walls. Target indicia imprinted on the outer surface of the front wall includes a central circular target area which has a diameter substantially equal to the diameter of the cylindrical bore and is coaxially aligned with the bore.

DETAILED DESCRIPTION OF THE PREFERRED EMBODIMENT

Figure 1:
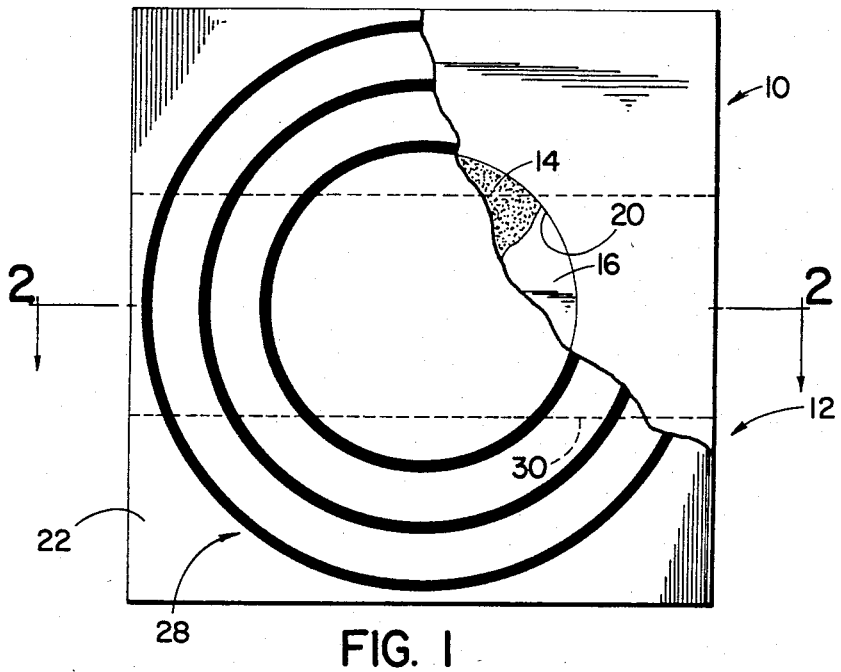
FIG. 1 is a front elevational view of an explosive target embodying the present invention and shown with a portion of the front wall broken away to reveal structure therebehind.

Turning now to the drawing, an explosive target embodying the present invention is indicated generally by the reference numeral 10. The target 10 is particularly adapted for use as a small bore rifle or pistol target and comprises a body assembly indicated generally by the numeral 12, an explosive charge 14, contained within the body assembly, and a charge retaining disc 16, which retains the charge in a predetermined position within the body assembly, as will be hereinafter more fully discussed.

The body assembly 12 has a generally rectangular block-shaped configuration and includes a body 18 which is made from a relatively soft, light-weight rigid or semi-rigid material which may be readily penetrated by a firearm projectile without risk of shattering. The illustrated body 18 is preferably made from a light-weight foamed plastic material such as beaded expanded polystyrene and has a central opening or cylindrical bore 20 which extends through it. The body assembly 12 further includes front and rear end walls indicated at 22 and 24, respectively, which are secured to the front and rear surfaces of the body 18 to provide closures for the front and rear ends of the cylindrical bore 20. The front and rear walls 22 and 24 are preferably made from relatively heavy paperboard and are secured to the body 12 by a suitable adhesive compound.

Any suitable stable explosive compound which will detonate upon projectile impact may be used in practicing the invention and there are many well-known commercially available explosive compositions which should be suitable for this purpose. However, I have found the following formula to be most satisfactory.

| | Parts by Weight |
|---|---|
| Potassium chlorate | 18 |
| Sulphur | 6 |
| black fine powdered aluminum (400 mesh) | 6 |
| Bran | 2–2.5 |

The aforementioned dry ingredients which include discrete loosely associated granular components are preferably mixed in dry form to produce the explosive charge 14.

As previously noted, the mixed charge 14 is contained within the bore 20 and is retained in a predetermined position within the body assembly by the charge retaining disc 16. The disc 16 is preferably made from a soft material such as polystyrene which may be readily penetrated by a projectile without fragmenting. Any suitable material may be used to make the disc, however, a foamed plastic material is presently preferred. The disc 16 has a diameter slightly larger than the diameter of the bore 20 to facilitate press-fit engagement within the bore. The disc retains the explosive charge 14 in a predetermined position within the body assembly 12 adjacent one of the end walls. Preferably, and as shown, the disc retains the charge 14 in a uniform layer adjacent the rear wall 24.

After the rear wall 24 has been attached to the body 18 the subassembly comprising the rear wall and the body is supported with the rear wall in a substantially horizontal position. The explosive charge 14 is then poured into the bore 20 and distributed therein as a uniform layer. Thereafter, the disc 16 is forcibly inserted into the bore and downwardly against the explosive charge 14 to retain the charge in a reasonably tightly-packed condition against the rear wall 24 so that the discrete particles which comprise the charge will not be prone to settle if the target 10 is stored with the bore 20 in an axially horizontal position.

Figure 2:
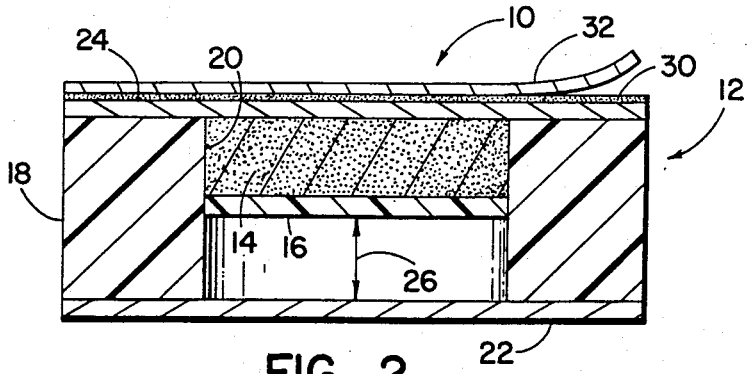
FIG. 2 is a sectional view taken along the line 2—2 of FIG. 1.

After the charge retaining disc 16 has been positioned within the bore 20 the front wall 22 is attached to the body 18. The body is preferably dimensioned so that the disc 16 is spaced from the front wall 22. The space between the disc 16 and the front wall 22, indicated by the numeral 26 in FIG. 2, is preferably at least twenty-five percent of the axial dimension of the bore 20.

Target indicia indicated generally at 28 is preferably imprinted on the outer surface of the front wall 22. In the illustrated target 10 the target indicia 28 comprises a plurality of concentric rings. The innermost or central ring, which comprises the bull's eye, has a diameter substantially equal to the diameter of the bore 20 and is imprinted on the front wall 22 in coaxial alignment with the bore 20, so that a projectile fired at the target and striking its central portion will impact upon the explosive charge 14 to detonate it.

A layer of pressure-sensitive adhesive 30 covered by a layer of release paper 32 is attached to the rear surface of the rear wall 24 for use in mounting the target on a suitable backing surface.

All of the materials which comprise the explosive target 10 are relatively soft materials which are readily penetrated by a projectile fired from a firearm and which will not fragment upon impact. Further, all of the materials from which the target is made are combustible and have kindling temperatures well below the temperature developed by the burning gases of explosion upon detonation of the explosive charge 14, so that the target 10 will be substantially consumed when a bull's eye is scored. In the event of a near bull's eye the projectile will penetrate the soft material of the body assembly which surrounds the explosive material 14 without causing the target to explode. When a bullet strikes the bull's eye the target will explode producing a loud report and a relatively large puff of smoke.

The rectangular block-shaped configuration of the target and the manner in which the explosive charge is retained therein facilitates packaging of a plurality of targets within a rectangular container without necessity for additional packing materials other than the carton itself. When several targets are packaged within a single container the targets are preferably arranged in layers and in back-to-back relation to each other so that the spaces between the discs 16, 16 and the front walls 22, 22 of the various targets are located adjacent associated outer sides of the carton, whereby the latter spaces impart further shock resistance to the package.

I claim:

1. An explosive target comprising a hollow body assembly having a generally rectangular block-shaped configuration and including a body having an opening extending therethrough, front and rear end walls attached to said body and forming closures for the front and rear ends of said opening, explosive charge means contained within said opening for detonation upon projectile impact, a charge retaining disc mounted in fixed position within said opening and maintaining said explosive charge means generally adjacent one of said end walls, and target indicia imprinted on the outer surface of said front end wall and including a central target area having a shape substantially identical to the cross sectional shape of said opening and aligned in registry with said opening.

2. An explosive target as set forth in claim 1 wherein said opening comprises a cylindrical bore and said central target area comprises a circular area having a diameter substantially equal to the diameter of said bore and coaxially aligned with said bore.

3. An explosive target as set forth in claim 2 wherein in the minor dimension of said body measured in a radial direction in the region surrounding said bore is at least equal to the radius of said bore.

4. An explosive target as set forth in claim 2 wherein said charge retaining disc is spaced from the other of said end walls a distance equal to at least twenty-five percent of the axial dimension of said bore.

5. An explosive target as set forth in claim 3 wherein said charge retaining disc is spaced from the other of said end walls a distance equal to at least twenty-five percent of the axial dimension of said bore.

6. An explosive target as set forth in claim 2 wherein said explosive charge comprises a dry mixture including discrete granular components maintained in substantially tightly packed relation to each other by said charge retaining disc and associated walls of said body assembly.

7. An explosive target as set forth in claim 6 wherein said one end wall comprises said rear end wall.

8. An explosive target as set forth in claim 7 wherein said charge retaining disc has a diameter before assembly slightly greater than the diameter of said cylindrical opening and said charge retaining disc is maintained in assembly with said body by press fit engagement with the wall of said cylindrical opening.

9. An explosive target as set forth in claim 2 wherein said charge retaining disc has a diameter for assembly slightly greater than the diameter of said cylindrical bore and said charge retaining disc is maintained in assembly with said body by press fit engagement with the wall of said cylindrical bore.

10. An explosive target as set forth in claim 2 wherein said target indicia comprises a plurality of concentric circles imprinted on the outer surface of said front wall and the innermost one of said circles defines said central target area.

11. An explosive target as set forth in claim 1 including a layer of pressure-sensitive adhesive attached to the rear surface of said rear end wall for securing said explosive target to another surface.

12. An explosive target as set forth in claim 1 wherein said body, said front and rear end walls and said charge retaining disc are made from combustible materials having kindling temperatures substantially below the temperature developed by said explosive charge means upon detonation.

13. An explosive target comprising a hollow body assembly having a generally rectangular block shape configuration and including a body having a cylindrical bore therethrough, said body assembly having front and rear end walls adhered to said body and forming closures for the front and rear ends of said cylindrical bore, explosive charge means contained within said bore for detonation upon projectile impact and including a mixture of loosely associated discrete granules, a charge retaining disc mounted in fixed position within said bore and maintaining said charge means in a layer of uniform thickness generally adjacent one of said end walls, said disc being spaced from the other of said end walls a distance at least equal to twenty-five percent of the axial dimension of said bore, and target indicia imprinted on the outer surface of said front end wall and including a plurality of concentric circles, the innermost one of said circles defining a central target area having a diameter substantially equal to the diameter of said bore and coaxially aligned with said bore.

14. An explosive target as set forth in claim 13 wherein the minor dimension of the portion of said body surrounding said bore and measured in a radial direction is at least equal to the radial dimension of said bore.

15. An explosive target as set forth in claim 14 wherein the materials comprising said body assembly and said charge retaining disc having kindling temperatures substantially lower than the temperature developed by the burning gases of explosion generated by detonation of said explosive charge.

* * * * *